US012187504B2

(12) United States Patent
Throup et al.

(10) Patent No.: US 12,187,504 B2
(45) Date of Patent: Jan. 7, 2025

(54) CONTAINER WITH LOCKING TAB CLOSURE

(71) Applicant: Multi Packaging Solutions UK Limited, Nottinghamshire (GB)

(72) Inventors: Richard Throup, Nottinghamshire (GB); Athal S. Nathanson, Nottinghamshire (GB)

(73) Assignee: Multi Packaging Solutions UK Limited (GB)

( * ) Notice: Subject to any disclaimer, the term of this patent is extended or adjusted under 35 U.S.C. 154(b) by 43 days.

(21) Appl. No.: 17/642,915

(22) PCT Filed: Sep. 11, 2020

(86) PCT No.: PCT/GB2020/052195
§ 371 (c)(1),
(2) Date: Mar. 14, 2022

(87) PCT Pub. No.: WO2021/048562
PCT Pub. Date: Mar. 18, 2021

(65) Prior Publication Data

US 2022/0402646 A1 Dec. 22, 2022

(30) Foreign Application Priority Data

Sep. 13, 2019 (GB) ..... 1913239

(51) Int. Cl.
*B65D 5/10* (2006.01)
*B65D 5/02* (2006.01)
*B65D 5/44* (2006.01)

(52) U.S. Cl.
CPC ..... *B65D 5/106* (2013.01); *B65D 5/0254* (2013.01); *B65D 5/443* (2013.01)

(58) Field of Classification Search
CPC ..... B65D 5/0254; B65D 5/10–106; B65D 5/103; B65D 5/6602; B65D 5/6608; B65D 5/445; B65D 5/443; B65D 5/0281
(Continued)

(56) References Cited

U.S. PATENT DOCUMENTS 2,034,594 A * 3/1936 Norris ..... B65D 5/062 229/125.42
2,337,039 A * 12/1943 Gardner, Jr. ..... B65D 5/103 229/117
(Continued)

FOREIGN PATENT DOCUMENTS

GB 638470 A * 6/1950
GB 1409591 A 10/1975

OTHER PUBLICATIONS

International Search Report issued in corresponding PCT Application No. PCT/GB2020/052195 on Nov. 13, 2020. (16 pages).

*Primary Examiner* — Nathan J Newhouse
*Assistant Examiner* — Phillip D Schmidt
(74) *Attorney, Agent, or Firm* — Brian J. Goldberg; Rohini K. Garg

(57) ABSTRACT

Herein is provided a container including a plurality of sidewalls (3, 7, 9) connected to one another along foldlines, and a base. The base includes first, second, third and fourth base flaps (11, 13, 15, 17) connected along respective foldlines to respective sidewalls. The second and third base flaps (13, 15) are folded over the first base flap (11) and the fourth base flap (17) is folded over the second and third base flaps (13, 15). The fourth base flap (17) includes a base panel portion which forms part of the exterior of the base and a locking tab portion connected to a distal end of the base panel portion. The locking tab portion is inserted into the interior of the container through a slot defined by the first, second and third base flaps (11, 13, 15) to retain the base in
(Continued)

a closed configuration. A cutline is provided extending inwardly from the side edge of the fourth base flap (17) on each side of the fourth base flap (17) at a transition between the base panel portion and the locking tab portion.

20 Claims, 7 Drawing Sheets

(58) Field of Classification Search
USPC ..... 229/130, 139, 155–157, 122.33, 122.34, 229/122.32, 185, 103, 199
See application file for complete search history.

(56) References Cited

U.S. PATENT DOCUMENTS 2,758,780 A * 8/1956 Imbs ..... B65D 5/0281 229/121
2,826,351 A * 3/1958 Anderson, Jr. ..... B65D 5/02 229/185
3,066,843 A * 12/1962 Johnson ..... B65D 5/16 221/75
3,482,734 A * 12/1969 Mierson ..... B65D 83/0811 229/242
3,801,001 A * 4/1974 Taylor ..... B65D 5/103 229/185
3,918,631 A * 11/1975 Hackenberg ..... B65D 5/0281 206/362
4,083,454 A 4/1978 O'Neill
4,477,017 A * 10/1984 Webinger ..... B65D 5/106 229/185
5,873,514 A 2/1999 Brooks
6,378,733 B1 * 4/2002 Boonzaier ..... B65D 77/065 229/117.14
7,900,816 B2 * 3/2011 Kastanek ..... B65D 5/064 220/592.2
9,004,344 B2 * 4/2015 Smith ..... B65D 5/0254 229/126
10,322,844 B2 * 6/2019 Boersma ..... B31B 50/81
11,511,905 B2 * 11/2022 Al-Housseiny .... B65D 5/46096
2011/0259948 A1 * 10/2011 Little ..... B65D 5/10 493/122

* cited by examiner

CONTAINER WITH LOCKING TAB CLOSURE

TECHNICAL FIELD

The present invention relates to containers made of cardboard, paperboard or other foldable sheet materials, and in particular to a base construction for such containers.

BACKGROUND

It is often desirable to provide containers made of cardboard, paperboard or other foldable sheet materials with a closed base. A closed base for such a container may be provided using a set of interlocking base flaps. When folded together in a particular manner, the base flaps interlock to provide the closed base. Such a base construction may provide a locked, closed base without the need for extrinsic closure components e.g. tape, adhesive, staples etc.

One example of such a base construction is known as an "envelope base". In general, an envelope base comprises first, second, third and fourth flaps. The second and third flaps are folded over the first flap, and the fourth flap is folded over the second and third flaps. A locking tab portion provided at a distal end of the fourth flap is inserted into the interior of the container through a slot defined by the first, second and third flaps to retain the base construction in a closed configuration. The resulting base construction may have the appearance of the reverse of an envelope when viewed from the exterior.

The Applicant has realized that conventional interlocked base constructions may not necessarily have sufficient strength to enable the container to function reliably to securely hold a product located in the container in certain contexts. The strength of the base construction is of particular importance where the container is intended to hold a fragile and/or relatively heavy product, such as a bottle.

The Applicant has realized that there is a need for an improved base construction for a container.

SUMMARY

From a first aspect, the present invention provides a container comprising;

- a plurality of sidewalls connected to one another along foldlines;
- and a base, wherein the base comprises;
- a first base flap connected along a foldline to a first one of the sidewalls;
- second and third opposed base flaps connected along respective foldlines to respective ones of the sidewalls adjacent the first sidewall on either side thereof, wherein the second and third base flaps are folded over the first base flap;
- and a fourth base flap connected along a foldline to a sidewall opposite the first sidewall, wherein the fourth base flap is folded over the second and third base flaps;
- wherein the fourth base flap comprises a base panel portion which forms part of the exterior of the base and a locking tab portion connected to a distal end of the base panel portion, wherein the locking tab portion of the fourth base flap is inserted into the interior of the container through a slot defined by the first, second and third base flaps to retain the base in a closed configuration;
- and wherein a cutline is provided extending inwardly from the side edge of the fourth base flap on each side of the fourth base flap at a transition between the base panel portion and the locking tab portion of the fourth base flap.

The container includes a base comprising four base flaps. Second and third base flaps are folded over a first base flap, and a fourth base flap is folded over the second and third base flaps. Each one of the second and third base flaps may comprise a proximal portion and a distal portion. The first, second and third base flaps define a slot. The slot is defined by portions of the first, second and third base flaps. The fourth base flap comprises a base panel portion which forms part of the exterior of the base and a locking tab portion at the distal end thereof. The locking tab portion is inserted through the slot into the interior of the container in order to retain the base in a closed configuration. The flaps thus provide an interlocked base for the container. The insertion of the locking tab portion through the slot retains the base in a closed configuration without the need for extrinsic fixtures, such as adhesive or tape.

This type of base may be referred to as an "envelope base".

In accordance with the invention, a cutline is provided extending inwardly from the edge of the fourth base panel on either side thereof at a transition between the base panel portion and locking tab portion thereof. The cutlines inhibit movement of the locking tab portion out of the slot. By this it is meant that the cutlines are arranged at least such that they may inhibit further movement of the locking tab portion out of the slot if the locking tab portion starts to move out of the slot, and preferably are arranged such that they inhibit any movement of the locking tab portion out of the slot. The cutlines cooperate with the edges of the second and third base flaps to inhibit movement of the locking tab portion out of the slot. The cutlines engage i.e. catch on the edges of the second and third base flaps to inhibit movement of the locking tab portion out of the slot.

The cutlines may cooperate with the second and third base flaps to inhibit any movement of the locking tab portion out of the slot or at least any further movement if the locking tab portion starts to move out of the slot. The cutlines may thus cooperate with the second and third base flaps to inhibit movement of the locking tab portion out of the slot at all times when the base is closed, or at least if a force acting on the interior of the base causes the locking tab portion to start to move out of the slot. Each cutline may be arranged to, and optionally does, receive an edge of one of the second and third base flaps to inhibit movement of the locking tab portion out of the slot. In this way, a force tending to cause the locking tab portion to start to move out of the slot may cause the locking tab portion to more engage the edges of the second and third base flaps to a greater extent.

In this way, the cutlines may respectively lock the second and third base flaps to the fourth base flap to inhibit movement of the locking tab portion out of the slot. Movement of the locking tab portion out of the slot may result in the base coming open, and is a common cause of failure of the base. The use of the cutlines may thus provide additional interlocking between the flaps of the base to increase resistance to opening of the base. The additional interlocking may, in particular, act to inhibit the locking tab portion from sliding out of the slot when a force is applied to the interior of the base in a direction tending to urge the base outwardly e.g. as may be applied by a product located within the container. As described below, it has been found that the use of cutlines may increase the maximum load from within the container which may be withstood by the base before opening of the base in comparison to a container of the same construction, without such cutlines.

The presence of the cutlines may provide additional integrity and strength to the base, and reduce the likelihood of it becoming inadvertently opened. The resulting base structure has been found to exhibit improved strength properties in contrast to the case in which such cutlines are not provided. In particular, the base structure has been found to provide sufficient strength for the container to be used even with relatively heavy products, such as bottles, and/or to enable the container to be used to house fragile products with a greater level of security.

The cutlines extend inwardly from the side edges of the fourth base flap on either side thereof at a transition between the base panel portion and locking tab portion thereof. The transition between the base panel portion and locking tab portion is the region at the distal end of the base panel portion in which the locking tab portion start to fold around for insertion into the interior of the base through the slot. The base panel portion forms part of the exterior of the base.

The second and third base flaps are disposed on either side of the fourth base flap. The sides are the lateral sides thereof. The cutlines extend inwardly toward a lateral centreline of the fourth base flap. Thus, the cutlines may comprise a first cutline extending inwardly from the edge of the fourth base flap on the side of the fourth base flap closer to the second base flap, and a second cutline extending inwardly from the edge of the fourth base flap on the side of the fourth base flap closer to the third base flap.

In embodiments only the first and second cutlines are provided in the fourth base flap i.e. no further cutlines are provided.

In accordance with the invention, each cutline may receive an edge of a respective one of the second and third base flaps. A first one of the cutlines may receive an edge of the second base flap and a second one of the cutlines may receive an edge of the third base flap. The edge of the second or third base flap is a part of a side edge thereof. The side edge is the side edge closer to the first base flap. Each cutline may receive an edge of one of the second and third base flaps at a transition between the proximal and distal portions of the second or third base flap respectively. In embodiments a side edge of each one of the second and third base flaps changes direction at a transition between the proximal and distal portions thereof, and each cutline receives an edge of a respective one of the second and third base flaps at the transition between the proximal and distal portions of the second or third base flap to inhibit movement of the locking tab portion out of the slot.

The locking tab portion of the fourth base flap refers to that portion which is tucked through the slot into the interior of the container. The transition between the base panel portion and locking tab portion of the fourth base flap as used herein refers to the region at which the external base panel portion transitions into the internal locking tab portion. In embodiments there is no identifiable distinction between the locking tab portion and base panel portion of the fourth base flap. Thus the transition may be a smooth transition. The base panel portion of the fourth base flap and the locking tab portion thereof may be continuous with one another. Preferably no foldline is provided between the base panel portion and locking tab portion. It has been found that this may reduce the likelihood of the locking tab portion starting to move out of the slot.

In embodiments in which each of the side edges of the fourth base flap changes direction as the base panel portion of the fourth base flap transitions into the locking tab portion, each cutline may extend inwardly from a respective one of the side edges of the fourth base flap in proximity to, (and optionally distal to), a point at which a direction of the side edge of the fourth base flap changes direction as the base panel portion of the fourth base flap transitions into the locking tab portion. (In proximity means that the cutline extends inwardly from the side edge of the fourth base flap at or adjacent the change in direction of the side edge, and optionally adjacent and distal thereto.) For example, in some embodiments the side edge of the base panel portion is straight and the side edge of the locking tab portion is curved. In other embodiments, an angle of inclination of the side edge relative to the foldline connecting the fourth base flap to the sidewall to which it is connected may change e.g. decrease. The change in angle of inclination may be a sudden change. This may then provide a locking tab portion having side edges which converge less steeply than do the side edges of the base panel portion.

Each cutline may extend less than 30%, or less than 25%, or less than 20% of a distance toward an opposite side edge of the fourth base flap. Alternatively or additionally, each cutline may extend at least 5%, or at least 10% or at least 15% of a distance toward an opposite side edge of the fourth base flap. The opposite side edge of the base flap is the edge having the other one of the cutlines. The distance is measured along a line extending parallel to the foldline connecting the fourth base flap to the sidewall of the container to which it is connected. The line is typically a notional line. The distance is measured starting from the point along the side edge at which the cutline starts to extend inwardly. The line may connect the points at which the cutlines start to extend inwardly from their respective side edges. It will be appreciated that, depending upon whether the cutlines are inclined, they may or may not extend along the line, but will, regardless of their orientation have a component which extends along the line.

Each cutline extends inward from its respective side edge of the fourth base flap toward a centre of the fourth base flap. The centre of the fourth base flap may be defined by a longitudinal centreline. The fourth base flap may be symmetrical about the longitudinal centreline of the flap. The longitudinal centreline extends perpendicular to the foldline connecting the fourth base flap to the sidewall to which it is connected at a point midway between the ends of the foldline. The height of the fourth base flap is measured in a direction perpendicular to the foldline connecting the base flap to the sidewall to which it is connected. The height dimension of the fourth base flap is the dimension in a direction parallel to the longitudinal centreline of the base flap.

The cutlines may be disposed at any suitable position along the height of the fourth base flap which will enable them to inhibit movement of the locking tab portion out of the slot of the container, at least if the locking tab portion starts to move out of the slot. The cutlines may be located such that they are not visible from the exterior of the base (when the material of the container is opaque). The cutlines may be disposed at least in part or entirely in the region in which the fourth base flap bends around to enter the interior of the container, and/or just within the interior of the container.

The cutlines preferably extend inwardly from points located at the same level relative to the fourth base flap. Thus the cutlines may extend inwardly from points along the edges of the fourth base flap located at the same height along the fourth base flap. Thus the points are located at the same distance from the foldline connecting the fourth base flap to the sidewall of the container to which it is connected. The distance may be a shortest distance taken along a line perpendicular to the foldline connecting the fourth base flap to the sidewall. Alternatively or additionally, the cutlines may extend inwardly from points along the side edges of the fourth base flap at the same distance along the respective side edges from the foldline connecting the fourth base flap to the sidewall of the container to which it is connected.

In some embodiments the cutlines do not converge with one another. Thus, in some embodiments, each cutline extends parallel to the foldline connecting the fourth base flap to the sidewall of the container to which the fourth base flap is connected. Each cutline may extend a distance along a line connecting the side edges of the fourth base flap and extending parallel to the foldline connecting the fourth base flap to the sidewall of the container to which it is connected.

In other embodiments the cutlines converge with one another. The cutlines are then inclined relative to the foldline connecting the fourth base flap to the sidewall of the container to which the fourth base flap is connected. The cutlines may be inclined toward the foldline connecting the fourth base flap to the sidewall of the container to which the fourth base flap is connected. The cutlines extend in a direction toward the proximal end of the fourth base flap as they extend inwardly from their respective side edges of the fourth base flap. Thus, the cutlines extend toward the base of the fourth base flap. The cutlines may extend into the base panel portion of the fourth base flap.

Providing cutlines which extend parallel to the foldline connecting the fourth base flap to its sidewall or which are inclined toward the foldline may result in an arrangement in which the cutlines are more effective in inhibiting movement of the locking tab portion out of the slot.

Each cutline is preferably a straight line.

A cutline as used herein refers to a slit in the substrate of the fourth base flap, formed without the removal of any of the material of the substrate.

The side edges of the base panel portion of the fourth base flap preferably converge with one another in the direction toward a distal end of the base panel portion. The side edges may be straight. In some embodiments the base panel portion of the fourth base flap is generally trapezoidal in shape.

The locking tab portion of the fourth base flap may be of any desired shape. In embodiments the locking tab portion comprises a pair of side edges separated by a distal end edge. The side edges are preferably curved. The distal end edge is preferably straight. This may assist with insertion of the locking tab portion through the slot defined by the first, second and third flaps as described herein.

The shape of the fourth base flap in the region of the transition to the locking tab portion may be disregarded when considering the general shape of the base panel portion and/or locking tab portion of the fourth base flap. The shape of the base panel portion or locking tab portion refers to the shape of the main body thereof, excluding a transition region. For example, the side edges may start to extend parallel to one another, or at least converge less steeply, in the transition region.

Preferably the side edges of the fourth base panel converge with one another less steeply in the locking tab portion than in the base panel portion. In this way, the amount of material forming part of the locking tab portion may be increased relative to that which would be provided if the side edges continued to converge at the same angle in the locking tab portion. Greater amounts of material in the locking tab portion have been found to be advantageous in enabling the locking tab portion to securely close the base when inserted through the slot, reducing the likelihood of the locking tab portion moving out of the slot. This may be achieved using a trapezoidal base panel portion and curved sided locking tab portion as exemplified above, or any other desired arrangement.

The locking tab portion is inserted through the slot defined by the first, second and third base flaps. The locking tab portion is inserted through the slot such that the locking tab portion is located within the interior of the container. The locking tab portion is visible from the interior of the container. Where the container is of an opaque material, the locking tab portion is not visible from the exterior of the container. The locking tab portion may overlie the interior of the first base flap.

The fourth base flap has a portion located inside the container i.e. the locking tab portion, and a portion located outside the container i.e. the base panel portion. The base panel portion defines a portion of the exterior of the base. At least a portion of each of the first, second and third base flaps also define respective portions of the exterior of the base. The exterior portions of the base provided by each of the second and third flaps may be generally triangular in shape. The exterior portion of the base provided by the first flap may be generally trapezoidal in shape.

It will be appreciated that references to a portion of a base flap defining a portion of the exterior of the base should be understood as referring to the portion of the base flap defining a portion of the exterior of the base structure as described herein. A portion of a surface of the flap may define a portion of the exterior surface of the base structure. Arrangements in which the base structure is covered in some way by another component would not be excluded.

The fourth base flap panel is folded over the second and third base flaps so that the base panel portion thereof overlies at least a portion of each of the second and third base panel flaps. The base panel portion may overlie at least a portion, and optionally the entirety of the distal portion of each of the second and third base flaps. The base panel portion may overlie a portion, and in embodiments, only a portion, of the proximal portion of each of the second and third base flaps. The fourth base flap panel may also overlie at least a portion of the first base panel (e.g. a portion of each of the distal edge portions), with the second and third base flaps being located between the portion of the first base panel and the fourth base flap panel. References to a flap overlying another flap do not exclude the presence of an intervening layer e.g. an intervening flap, unless the context demands otherwise.

The second and third base flaps are folded over the first base flap. The second and third base flaps will each overlie at least a portion of the first base flap e.g. respective side regions thereof. The second and third base flaps may overlie at least the distal edge portions of the first base panel and, in embodiments at least a portion of the proximal portion of the first base flap on either side of the first base flap.

The second and third base flaps each comprise a proximal portion and a distal portions. The slot may be defined by an edge region of the distal portion of each one of the second and third base flaps and an edge defined by the first base flap. In these embodiments, the edge defined by the first base flap which cooperates with the edge region of the distal portion of the second base flap and the edge region of the distal portion of the third base flap to define the slot through which the locking tab portion is inserted may be an edge of the first base flap, or an edge defined within the first base flap. The edge is preferably a straight edge, although it is envisaged that other configurations may be used.

In some embodiments the first base flap comprises a recess formed in a distal end thereof, wherein a portion of the distal edge of the first base flap defining a proximal end of the recess provides the edge of the first base flap which cooperates with the edge regions of the distal portions of the second and third base flaps to define the slot through which the locking tab portion of the fourth base flap is inserted. The recess may have a depth of less than 50% of the height of the first base flap. The depth of the recess and the height of the first base flap are measured in a direction perpendicular to the foldline along which the first base flap is connected to the first sidewall. The recess may comprise a proximal edge and a pair of side edges. The side edges may converge in a direction toward the distal end of the recess.

The first base flap may comprise distal end portions on either side of the recess. The distal end portions may be located so as to be visible from the interior of the container and/or so as not to be visible from the exterior of the container when it is made of an opaque material. The inner side edges of the distal end portions provide the side edges of the recess. Thus, the inner side edges of the distal end portions may converge with one another in a direction toward the distal end of the flap. The outer edges of the distal end portions may converge with one another toward the distal end of the flap. An end edge of the distal end portion may define an acute angle with the inner side edge thereof. Such arrangements may result in inner edge regions of the distal end portions of the first base flap defining hooks. In preferred embodiments an inner edge region of each distal end portion of the first base flap defines a hook. Such arrangements may impart the base structure with greater strength, further reducing the likelihood of the locking tab portion of the fourth base flap moving out of the slot. The hooks may cooperate with the second and third base flaps to retain the second and third base flaps in position. This in turn enables the second and third base flap e.g. the distal portions thereof to continue to retain the locking tab portion of the fourth base flap within the container.

In other embodiments the first base flap comprises an opening in a distal portion thereof, wherein a proximal end of the opening provides the edge of the first base flap which cooperates with edge regions of the distal portions of the second and third base flaps to define the slot through which the locking tab portion of the fourth base flap is inserted. Where provided, an opening may be of any configuration e.g. square or rectangular, or may comprise one or more curved edge. The opening may comprise a proximal edge, a distal edge and side edges connecting the proximal and distal edges.

Thus a slot defining edge defined by the first base flap may be an edge of the first base flap e.g. provided by an edge of a recess, or may be an edge within the first base flap e.g. provided by an edge of an opening therein.

In some preferred embodiments the distal portions of each of the second and third base flaps define hooks. The hooks may be tucked behind a slot defining edge of the first base flap.

The slot through which the locking tab portion of the fourth base flap is inserted may be defined by an edge region of the distal portion of each one of the second and third base flaps and an edge defined by the first base flap. The edge regions of the distal portion of the second and third base portions may provide an edge of the slot. The inner edges of the distal portions of the second and third base flaps may be spaced from one another. Thus, there may be a discontinuity along an edge of the slot provided by the edge regions of the distal portions of the second and third base flaps.

The slot may be defined by abutting edges defined by the first, second and third base flaps (e.g. the distal portions of the second and third base flaps), or by an edge defined by the first base flap and underlying surfaces of the second and third base flaps e.g. of the distal portions thereof.

The edge regions of the distal portions of the second and third base flaps are associated with the edges of the distal portions of the flaps closer to the base of the first base flap. The edges are closer to the second sidewall. This is in contrast to the opposite edges of the distal portions which are closer to the first sidewall or the base of the fourth base flap.

The slot may be defined by an edge of the distal portion of each one of the second and third base flaps and the edge defined by the first base flap and/or by a surface of the distal portion of each one of the second and third base flaps and the edge defined by the first base flap. The surface is an outer surface distal portion. The surface of the distal portion is the surface in a region facing the inner surface of the first base flap.

In some embodiments the slot may be defined by the edge of the distal portion of the respective base flap. For example, this may be the case where the distal portions of the second and third base flaps do not comprise hooks, or comprise relatively shallow hooks. In some embodiments an edge of the distal portion of the second base flap and an edge of a distal portion of the third base flap each extend along the edge defined by the first base flap to define the slot therewith. The edge of the distal portion is a side edge thereof. The side edge is the side edge closer to the base of the first base flap to the first sidewall.

In other embodiments in which the distal portions of the second and third base flaps comprise hooks, the slot may be defined by the edge defined by the first base flap and a surface of the distal portion of each one of the second and third base flaps in the region of the hook. This may be the case, for example, where the distal portions of the flaps comprise relatively deeper hooks. The slot may be defined by the edge defined by the first base flap and the surfaces of the distal portions of the second and third base flaps in a region forming part of the hook or in proximity thereto. The slot may be defined by the edge defined by the first base flap and by an outer surface of each hook. The outer surface of the hook is the surface which faces the inner surface of the first base flap. The outer surface faces toward the exterior of the container. For example the slot may be defined by the edge defined by the first base flap and the surface of the distal portion of each one of the second and third base flaps in the region of the base of its hook. Depending upon the shape of the hook, in other embodiments, any part of the surface of the distal portion of the second or third base flap forming part of the surface of the hook may define part of the slot.

The slot may therefore be a slot between an edge defined by the first base flap and edges of the distal portions of the second and third base flaps, or between an edge defined by the first base flap and surfaces of the distal portions of the distal portions of the second and third base flaps adjacent the edge. It will be appreciated that the locking tab portion of the fourth base flap extends through the slot in the erected container, with the base in its closed configuration. The slot may or may not be defined before the locking tab portion of the fourth base flap is inserted into the interior of the container. For example, where the distal end regions of the second and third base flaps do not comprise hooks, the edges of the distal portions may define a slot together with the edge defined by the first base flap before the locking tab portion is pushed into the interior of the container. The edges of the distal portions may be spaced from the edge defined by the first base flap. In other embodiments, for example where the second and third base flaps comprise hooks, the ends of the hooks may be tucked behind the edge of the first base flap. In these cases, the insertion of the locking tab portion into the interior of the container may deflect the hooks to create the slot. The slot may then be between surfaces of the distal portions of the second and third base flaps and the edge defined by the first base flap.

Where the second and third base flaps comprise hooks, the hooks are preferably tucked behind the slot defining edge defined by the first base flap. This may further help to retain the locking tab portion of the fourth base flap located within the container, and thus strengthen the base. At least a base of the locking tab portion may be sandwiched between the hooks and a region of the first base flap proximal to the slot defining edge defined by the first base flap. The distal portions of the second and third base flaps may therefore extend inwardly of the slot defining edge of the first base flap into the interior of the container.

The side edge of the distal portion of the second or third base flap closer to the base of the first base flap (which may be a slot defining edge) may be a straight edge. The edge may extend parallel to the foldline connecting the first base flap panel to the first sidewall, or may be inclined relative thereto so as to converge with the foldline in a direction toward the distal end of the second or third base flap. This may result in the distal portion of the flap defining a hook as described above.

The side edge of the distal portion of the second or third base flap may define an acute angle with respect to the distal end edge of the distal portion of the flap (which provides a distal end edge of the flap). The angle may be an angle of at least 45 degrees, or at least 60 degrees, or at least 75 degrees. An acute angle may result in the distal portion defining a hook as described above.

The shapes of the proximal and distal portions of the second or third base flaps may be selected as desired. The proximal and/or distal portion of either or both of the second and third base flaps may be in accordance with any of the embodiments described herein. It has been found that the shapes of the proximal and distal portions of the flaps may be adjusted to control the strength of the base of the container. The most appropriate shape for any particular configuration will depend at least in part upon the shapes of the other flaps, or portions thereof, which engage with one another to provide the base, and the intended use of the container e.g. the product with which it is intended to be used. For example, where the distal portions define hooks, the shape of the hooks e.g. the sharpness of the ends of the hooks may be varied as desired.

The side edge of the distal portion of the second or third base flap (closer to the base of the first base flap, and which may be a slot defining edge) joins a side edge of the proximal portion of the respective base flap at a transition between the distal and proximal portions of the flap. The transition is preferably a sharp transition. The side edge of the distal portion may define an angle of at least 80 degrees, or at least 90 degrees, or at least 120 degrees, or at least 135 degrees with the side edge of the proximal portion of the respective base flap. The side edge of the proximal portion of the flap extends to the base of the respective base flap at the foldline connecting the base flap to the sidewall to which it is connected. The side edge of the proximal portion of the flap may be a straight side edge. In other embodiments the side edge of the proximal portion comprises a first portion to which the edge of the base flap is joined, and a second portion connecting the first portion to the foldline connecting the base flap to the sidewall to which the flap is connected. At least the first portion of the side edge of the proximal portion of the flap is preferably straight. In embodiments the second portion of the side edge of the proximal portion of the flap is also straight. The side edge then changes direction where the first and second portions thereof join one another. The second portion may define an angle with respect to the foldline connecting the base flap to the sidewall to which it is connected which is greater than an angle defined between the first portion and the foldline.

The shape of the proximal portion of the second or third base flap may be selected as desired.

The side edge of the proximal portion of the base flap closer to the base of the first base flap may extend to the foldline at the corner of the container connecting the sidewall to which the respective one of the second and third base flaps is connected and the first sidewall, or may terminate along the foldline connecting the respective one of the second and third base flaps to the sidewall to which it is connected at a point spaced from the foldline at the corner of the container connecting the sidewall to which the respective one of the second and third base flaps is connected and the first sidewall.

The second or third base flap may define a straight side edge which provides a side edge of the proximal and distal portions thereof at its side opposite that closer to the base of the first base flap i.e. on the side closer to the base of the fourth base flap (or the sidewall to which the fourth base flap is connected along a foldline). The side edge may extend perpendicular to the foldline connecting the flap to its respective sidewall.

In embodiments the side edges of the distal portion of the second or third base flap diverge from one another toward the distal end of the flap. Alternatively or additionally, the side edges of the proximal portion of the second or third base flap may converge with one another toward a distal end of the proximal portion of the second or third base flap. In embodiments, the side edge of the second or third base flap closer to the base of the fourth base flap extends along a straight path, perpendicular to the foldline connecting the second or third flap to the sidewall to which it is connected.

The distal end edges of the second and third base flaps may be spaced from one another. At least a portion of the distal portion of each one of the second and third base flaps is located in the interior of the container e.g. so as to be visible from the interior of the container and/or so as not to be visible from the exterior of the container when the container is of an opaque material.

The second and/or third base flaps may incorporate any of the features described above in relation to the second or third base flap. Preferably each flap is of the same shape. The second and third base flaps may be mirror images of one another.

The first, second, third and fourth base flaps may be the only flaps making up the base. However, in other embodiments, it is envisaged that one or more reinforcement flaps may be provided underlying respective ones of the base flaps.

In some embodiments a respective reinforcement flap is provided underlying one or preferably both of the first and fourth base flaps. A reinforcement flap is provided for each of the base flaps where such a flap is provided for each of the first and fourth base flaps. Each reinforcement flap may lie within the outer contour of its respective base flap. Each reinforcement flap may be of the same shape or different shape to its corresponding base flap. This may result in a doubling up of at least some of the base flaps to enhance the strength of the base.

Each reinforcement base flap may be unsecured to the inner surface of its respective base flap. In these embodiments the reinforcement flap is unbonded to the base flap e.g. by adhesive or any other form of attachment.

The reinforcement base flap is in a facing relationship with its respective base flap, and is preferably in face to face contact with the inner surface of its respective base flap. The outer surface of the reinforcement flap faces, or preferably is in contact with the inner surface of the base flap.

The reinforcement flaps may be provided in any suitable manner. For example, they may be connected to respective sidewalls of an inner shell of the container along respective foldlines. The container may comprise such an inner shell. The sidewalls to which the first, second, third and fourth base flaps are connected may then be sidewalls of an outer shell of the container. It will be appreciated that the container may comprise an inner shell whether or not reinforcement flaps are provided in respect of any of the base flaps. In accordance with the invention in any of its aspects or embodiments the container may comprise inner and outer shells. The outer shell may then comprise the sidewalls to which the first, second, third and fourth base flaps are connected. Where one or more reinforcement flap is provided, the or each reinforcement flap may be connected to a respective sidewall of the inner shell.

The container may comprise first, second, third and fourth sidewalls. The first base flap is then connected to the first sidewall, the second base flap is connected to the second sidewall, the third base flap is connected to the third sidewall and the fourth base flap is connected to the fourth sidewall. The first and fourth, and second and third sidewalls form opposed pairs of sidewalls. The second and third sidewalls are adjacent to the first sidewall on either side thereof. The second and third sidewalls are also adjacent to the fourth sidewall on either side thereof. While reference has been made to first-fourth sidewalls, the invention is not limited to use with a container having only four sidewalls, although in some embodiments the container does have four sidewalls.

The container may be of a parallelpiped shape.

Each sidewall may be square or rectangular.

The container is preferably a single piece container. This may be the case equally in embodiments comprising inner and outer shells.

The container is erected from a blank. The blank is preferably a single piece blank.

Where the container includes inner and outer shells, the inner and outer shells may be part of a single blank from which the container is erected.

The present invention extends to a blank erectable to provide a container in accordance with any one of the embodiments described herein. The blank is preferably a single piece blank.

The present invention extends to a container in accordance with the invention in any of its aspects or embodiments containing a product, wherein the base of the container supports the product. The product may be a fragile product, such as a bottle.

The end of the container at which the base is located may be referred to as the first end of the container. The container has a second end opposite the first end. The base may be at the end of the container intended to lie lowermost in use. The base is used to support a product located in the container in use.

The container may comprise a lid at an end thereof opposite the base i.e. at the second end thereof. Thus, both ends of the container may be closed. The lid may be of any desired construction. The lid may comprise first and second flaps connected along foldlines to opposed ones of the sidewalls of the container, and a third flap connected along a foldline to a further sidewall of the container, between the opposed sidewalls, the third flap being folded over the first and second flaps. The third flap may comprise a proximal lid panel portion and a locking tab portion connected along a foldline to the lid panel at a distal end thereof. The lid may provide a releasable lid structure. However, in other embodiments it is envisaged that the end of the container opposite the base may be open. In yet other embodiments, the lid may be bonded in a closed configuration e.g. using adhesive or heat sealing or any other bonding technology or technologies.

In accordance with the invention in any of its aspects or embodiments, the container is made of cardboard, paperboard or other foldable sheet material. The foldable sheet material may be a material such as paperboard or cardboard, or even a plastics material. The material may be chosen as desired. Preferably a non-plastics material is used.

A fold line as referred to herein refers to any line about which components have been folded. The fold line may comprise a line of weakness, crease line and/or perforations. If not explicitly stated, and unless inconsistent therewith, any connection described herein may be about a fold line.

Any reference to a height of a flap refers to a dimension as measured in the direction extending between the proximal and distal ends of the flap.

The term "at least some" refers to one or more.

The present invention in accordance with any of its further aspects or embodiments may include any of the features described in reference to other aspects or embodiments of the invention to the extent it is not mutually inconsistent therewith.

BRIEF DESCRIPTION OF DRAWINGS

Some preferred embodiments of the invention will now be described by way of example only and with reference to the followings drawings, of which.

DETAILED DESCRIPTION

Figure 1:
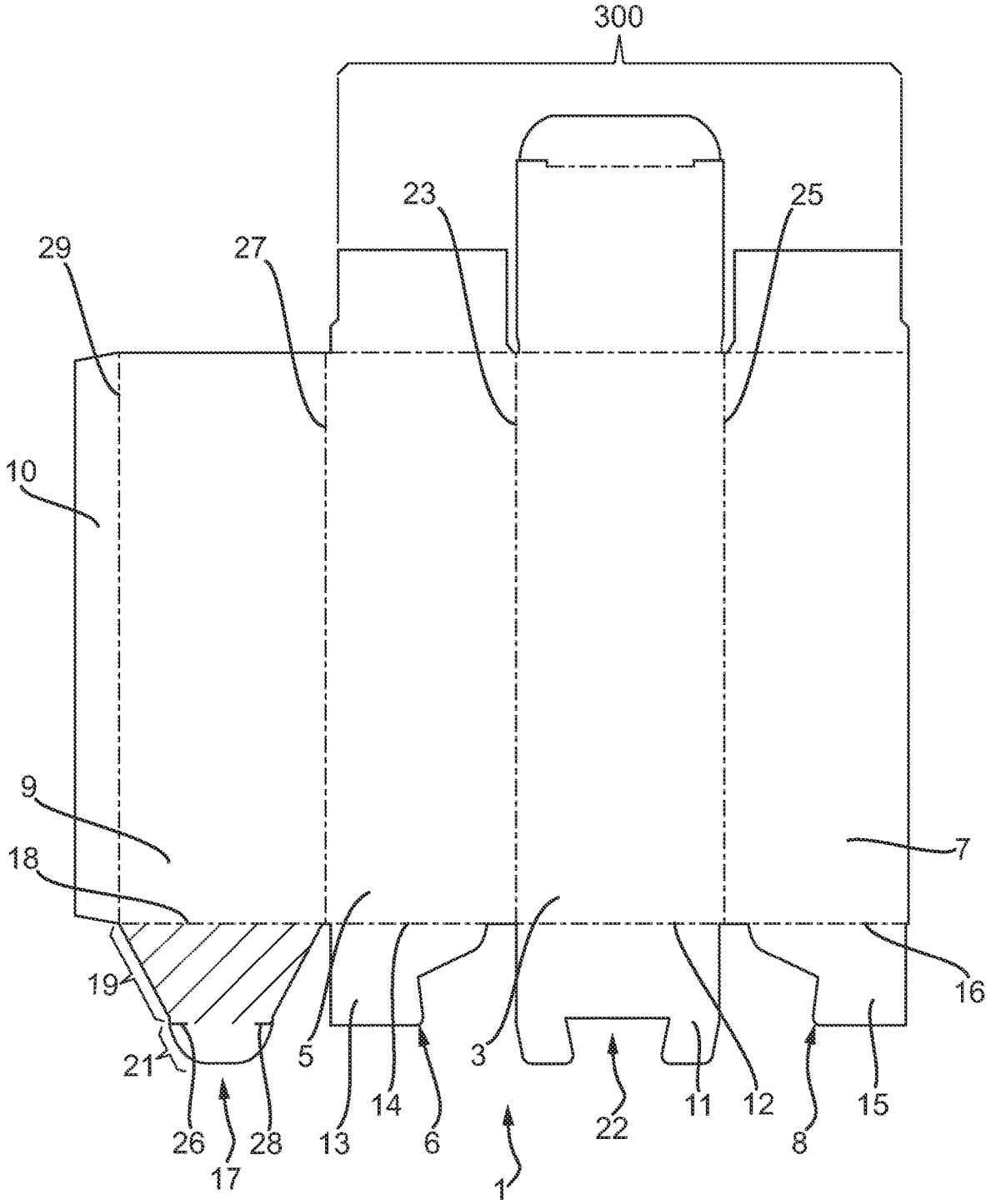
FIG. 1 shows a blank in the flat for forming a container in accordance with a first embodiment of the present invention.

With reference to FIG. 1, a blank for providing a container in accordance with a first embodiment of the invention will now be described.

FIG. 1 shows the blank in the flat from above, from the side which will provide the exterior of the erected container.

The blank 1 includes a first sidewall 3, a second sidewall 5, a third sidewall 7, and a fourth sidewall 9. The first and second sidewalls are connected to one another along a foldline 23, and the first and third sidewalls are connected to one another along a foldline 25. The second and fourth sidewalls are connected to one another along a foldline 27. A glue flap 10 is connected to the fourth sidewall 9 along a foldline 29.

The components of the base construction of the container will now be described.

A first base flap 11 is connected to the end of the first sidewall along a foldline 12. A second base flap 13 is connected to the end of the second sidewall 5 along a foldline 14. A third base flap 15 is connected to the end of the third sidewall 7 along a foldline 16. A fourth base flap is connected to the end of the fourth sidewall 9 along a foldline 18.

The first base flap has a recess 22 at its distal end.

The fourth base flap 17 has a base panel portion 19 which lies to the exterior of the container when erected and a locking tab portion 21 at the distal end of the base panel portion 19. The locking tab portion 21 lies within the container when erected.

The approximate extent of the base panel portion 19 is shown in hatched lines for ease of illustration in FIG. 1. The exact extent of the portion of the fourth base flap which will form part of the exterior of the base in the erected container, and thus the extent of the base panel portion 19, will depend upon the nature of the materials used e.g. the basis weight thereof, and the manner of erection of the blank. In the embodiment illustrated, the locking tab portion extends distally from approximately the level of the cutlines 26, 28, which will be located on the exterior of the container. It will be appreciated that there is no foldline or other feature extending between the edges of the fourth base flap to delineate the locking tab portion and base panel portions thereof. It has been found that it is advantageous not to include a foldline or similar to separate the locking tab portion from the base panel portion as such a foldline may undesirably interfere with the ability of the locking tab portion to be fully inserted through a slot defined by the first, second and third base flaps as described herein when erecting the container. Consequently, the provision of such a foldline or similar may disadvantageously increase the tendency of the locking tab portion to move out of the slot.

A pair of cutlines 26, 28 are provided, one on either side of the fourth base flap 17, extending inward from the side edge of the base flap. In the illustrated embodiment the cutlines are straight lines extending parallel to the foldline 18 connecting the fourth base flap to the fourth sidewall, and are located at the same distance as each other from the foldline i.e. so as to be at the same height within the fourth base panel 17.

A set of flaps 300 are provided at the opposite end of the sidewalls to the base, which may be used to provide a lid for the container. These flaps are of conventional construction and will not be described further.

The construction of the base flaps will now be described in more detail by reference to FIG. 2.

The first base flap 11 has a proximal portion 35 and a pair of distal end portions 37, 39 on either side of the recess 22. The recess 22 has a proximal end edge 41 and side edges 43, 45, which also provide inner edges of the distal end portions 37, 39. The distal end portions 37, 39 have outer side edges 47, 49 and end edges 55, 57. The proximal portion has side edges 51, 53. Again, the distal end portions are shown as hatched regions merely for the purposes of illustration, and do not imply that any detectable discontinuity or other feature separates these regions from the proximal portion of the flap.

In the exemplary first base flap shape shown, the side edges 51, 53 of the proximal portion 35 are parallel to one another, and the outer side edges 47, 49 of the distal end portions 37, 39 converge with one another toward the distal end of the flap, such that the distal portions of the first base flap define hooks 46, 48. The inner edges 41, 43 of the distal end portions 37, 39 and hence the side edges of the recess 22 converge with one another toward the distal end of the flap 11. Of course, other shapes may be used. For example, the inner and/or outer side edges of the distal end portions may extend parallel to one another. The configuration and extent of the recess may be different from that shown.

The second and third base flaps 13, 15 are mirror images of one another in the embodiment illustrated. The features of the flaps will be described by reference to the second base flap 13. The corresponding parts of the third base flap 15 will be marked annotated by a "'" sign.

The second base flap 13 has a proximal portion 61 and a distal portion 63.

The distal portion is shown as a hatched region merely for the purposes of illustration, and this does not imply that any detectable discontinuity or other feature separates these regions from the proximal portion of the flap. The second base flap has a distal end edge 65 and a side edge 67 which provides a side edge of both the proximal and distal portions on the side closest to the fourth base flap 17. The distal portion 65 of the second base flap has a side edge 69 on the side closer to the first base panel 11. On the same side of the second base flap, the proximal portion 61 of the second base flap has a first portion 70 joined to the side edge 69 of the distal portion 65, and a second portion 71 joining the first portion 70 to the foldline 14 connecting the second base flap to the second sidewall.

An angle $\alpha$ is defined between the end edge 65 and the side edge 69 of the distal portion 63. The angle is an acute angle. In this way, hooks 50, 50' are defined by the second and third base flaps. An angle $\beta$ is defined between the side edge 69 of the distal portion 63 of the flap and the first portion 70 of the side edge of the proximal portion 61. The side edge 69 of the distal portion 63 is a straight edge. The side edge of the proximal portion 61 extends straight through the first portion 70 thereof until closer to the foldline 14, before changing to approach the foldline 14 more steeply in the second portion 71. The second portion 71 of the side edge meets the foldline 14 so as to be spaced from the edge of the first end flap.

Of course, different shapes may be used, and the second base flap may extend to the edge of the adjacent first base flap i.e. at the corner between the first and second sidewalls 3, 5 in the erected container. The angles $\alpha$, $\beta$ may be varied. The angle $\beta$ at which these side edge portions meet may be controlled to aid in maintaining the locking tab portion 19 in its tucked in position, and to enhance strength of the base. The angle $\alpha$ may be 90 degrees. However, an acute angle may create a hook and help to enhance retention of the locking tab portion 19 within the slot defined by the distal edges 69, 69' of the second and third base flap portions in use. The side edge of the proximal portion need not have distinct first and second portions as illustrated. For example, the first portion 70 may continue along a straight path until it meets the foldline 14 e.g. adjacent the first flap.

Figure 2:
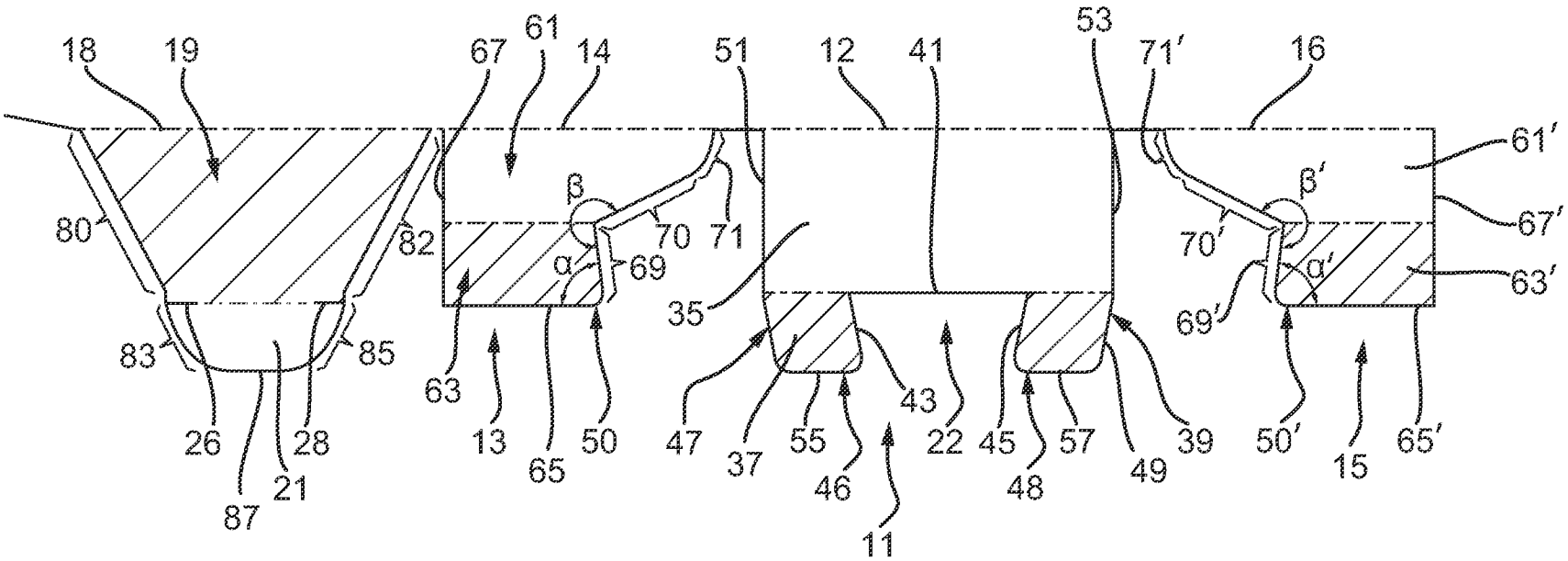
FIG. 2 illustrates the configuration of the base flaps used in the blank of FIG. 1 in more detail.

The features of the fourth base flap 17 have been previously described and are indicated again in FIG. 2. In FIG. 2 a dotted line is used to indicate the approximate extent of the base panel portion 19 of the fourth base flap 17, although this is for illustration only as described above. The side edges of the flap 17 converge with one another along first portions 80, 82. The side edges then change direction becoming briefly parallel as the base panel portion 19 transitions into the locking tab portion 21, which has curved side edges provided by the side edge portions 83, 85. The change in shape between the main body of the base panel portion 19 and the locking tab portion 21, resulting in the side edges of the flap converging less steeply in the locking tab portion, ensures that the amount of material present in the locking tab portion which is located to the interior of the container when the base is closed may be maximized. The locking tab portion 21 has a straight end edge 87 extending parallel to the foldline 18.

It will be seen that the base panel portion 19 is generally trapezoidal. The region in which the base panel portion 19 starts to transition into the locking tab portion 21 is not taken into account when considering the general shape of the base panel portion 19, which is defined by the shape of the main body of the base panel portion.

The cutlines 26, 28 extend inward from the side edges of the fourth base flap at the transition between the base panel portion 19 and the locking tab portion 21. The cutlines are therefore provided at the base of the locking tab portion. The cutlines may be located at any position along the height of the fourth base flap in the region of the transition between the base flap portion and locking tab portion which enables them to cooperate with the edges of the second and third base flaps as described herein.

Figure 7:
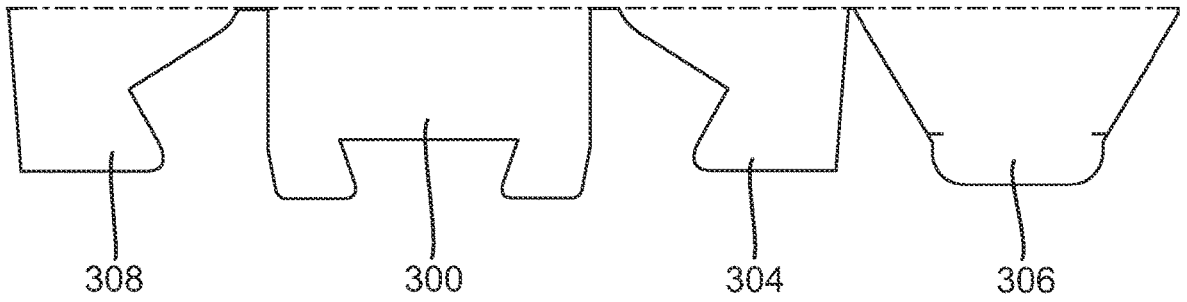
FIG. 7 illustrates yet another possible flap configuration.

It will also be understood that the shape of the various base flaps may differ from those shown in the embodiment of FIGS. 1 and 2. For example, the shape of the recess in the distal end of the first base flap 11 may differ. The inner and/or outer edges of the distal portions of the first base flap need not converge with one another to define hooks. The angle made by the side edge 69, 69' of the distal portion of the second and third base flaps may differ from that illustrated, to result in no hooks being defined, or hooks having ends with differing levels of sharpness, as may the angle defined where the side edge of the distal portion meets the side edge of the proximal portion. The side edge of the proximal portion need not be formed from two distinct portions as shown. Finally the shape of the locking tab and/or base panel portion of the fourth base flap may differ from that shown. FIG. 7 illustrates an alternative flap configuration in which the second and third base flaps define sharper hooks.

The configuration of the cutlines may differ from that shown. A detail of an alternative cutline configuration accordance with a further embodiment of the invention will now be described by reference to FIG. 3. The container of this embodiment is identical to that of the earlier embodiment, other than in the orientation of the cutlines (although may incorporate any of the modifications described in relation to the earlier embodiment).

The first, second third and fourth base flaps 111, 113, 115, 117 in this embodiment are of identical construction to those of the earlier embodiment described by reference to FIG. 2. However, in this embodiment, rather than extending parallel to the fold line 118 connecting the fourth base flap 117 to the fourth sidewall, the cutlines 126, 128 converge with one another, being inclined toward the base of the fourth base flap 117 i.e. toward the fold line 118.

Figure 3:
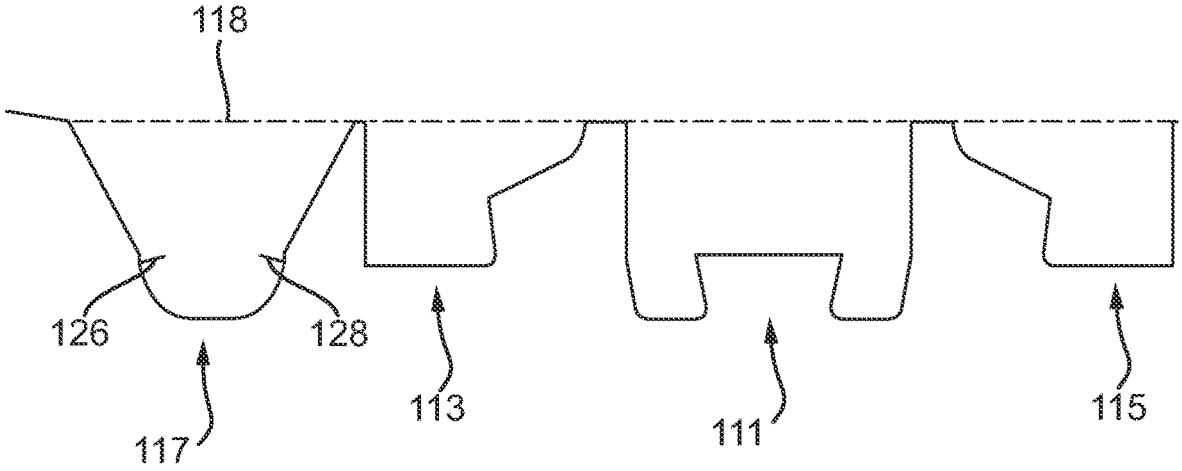
FIG. 3 illustrates an alternative configuration of base flaps which may be used in embodiments of the invention.

It has been found that the configuration of the cutlines shown in either of the FIG. 2 or 3 embodiments may be advantageous in supporting the function of the cutlines in inhibiting movement of the locking tab portion out of the slot after initial closing of the base.

One embodiment of erecting the blank of the embodiment of FIGS. 1 and 2 to form a container will now be described by reference to FIGS. 4A-G. Erection of the blank of FIG. 3 would proceed in the same manner.

With the blank located with the opposite surface to that shown in FIG. 1 uppermost i.e. with the surface that will form the interior of the container uppermost, the blank is folded about the third foldline 27 to result in the fourth sidewall 9 overlying the second sidewall 5. Glue is applied to the exterior surface of the glue flap 10 i.e. the surface uppermost in FIG. 1, and the blank folded about the second foldline 25 to result in the third sidewall 7 overlying the first sidewall 3 and with the free edge of the third sidewall 7 overlying the glue flap 10 to adhere the third sidewall 7 thereto.

Figure 4A:
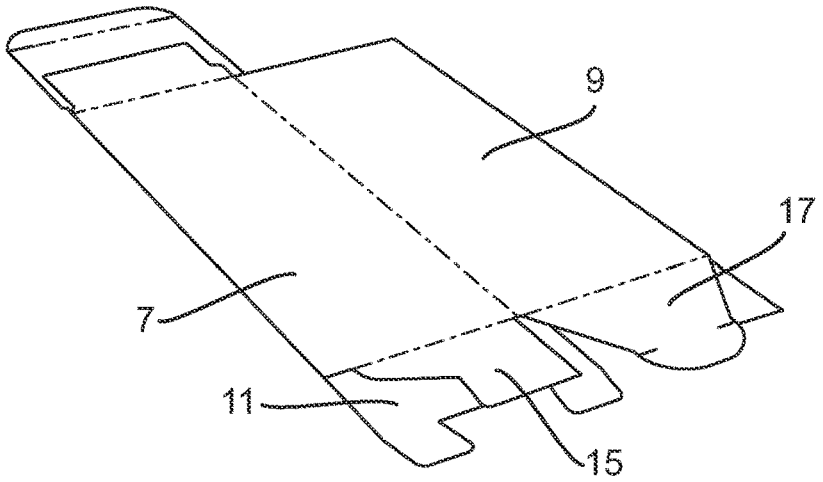
FIGS. 4A-G illustrate one method of erecting the blank of FIG. 1.

The result of this initial folding and gluing stage is shown in FIG. 4A. The folded and glued blank is in a flat configuration.

Figure 4B:
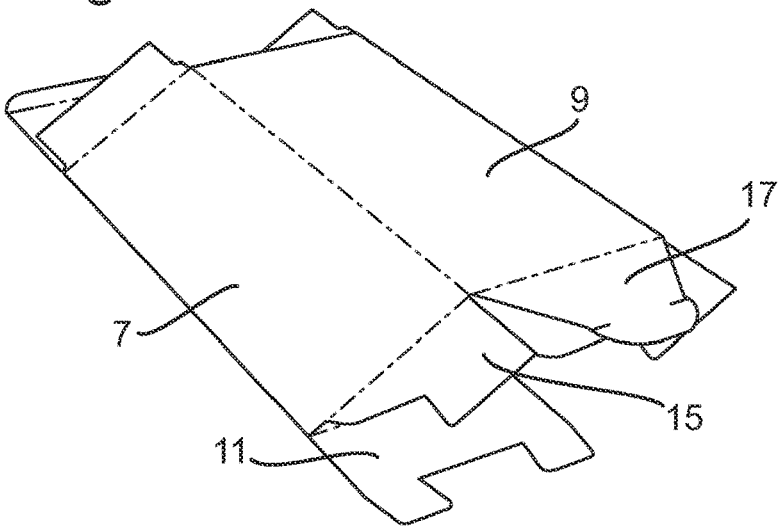
Figure 4C:
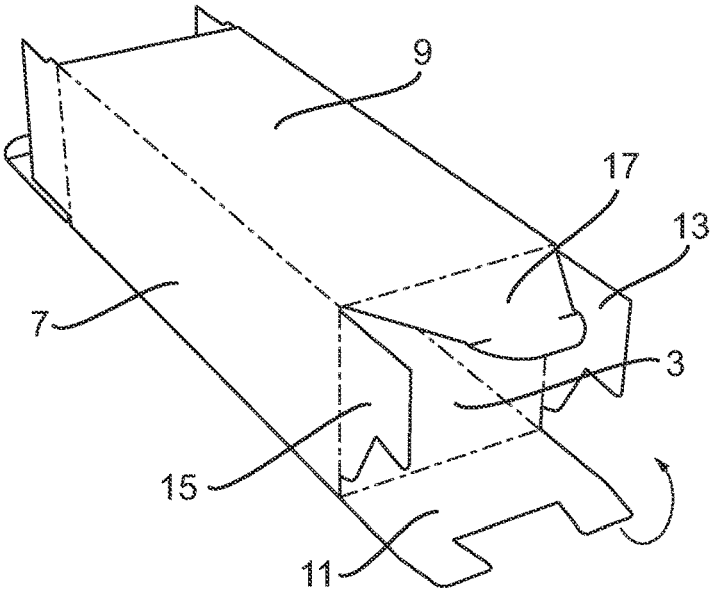

The fourth, third and second sidewalls 9, 7, 5 are then rotated relative to the first sidewall 3 through the position shown in FIG. 4B to reach the position shown in FIG. 4C, in which the container is in an erect configuration, but with the lid and base open. This may be achieved e.g. by applying suction to the upper surface of the folded blank shown in FIG. 4A, or by urging the sides of the folded blank inwardly, or in any suitable manner.

The steps involved in closing of the base will now be described.

Figure 4D:
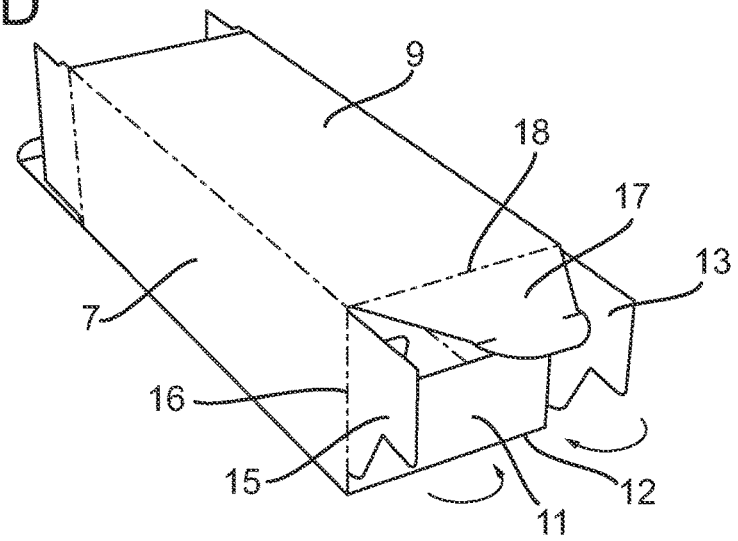

The first base flap 11 is rotated about the foldline 12 in the direction shown in FIG. 4C to the position shown in FIG. 4D, lying perpendicular to the first sidewall 3.

Figure 4E:
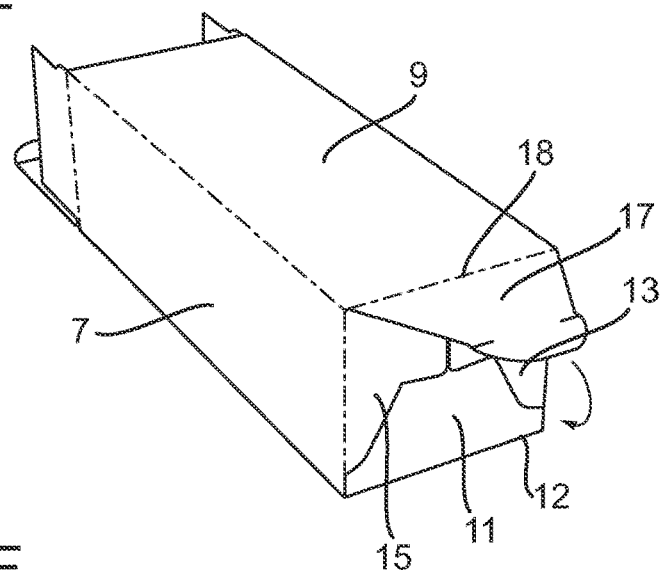

The second and third base flaps 13, 15 are then rotated about the respective foldlines 14, 16 connecting them to the second and third sidewalls in the direction of the arrows shown in FIG. 4D to the position shown in FIG. 4E in which each base flap is perpendicular to the sidewall to which it is connected. The second and third base flaps 13, 15 are thus folded over the first base flap 11.

Figure 4F:
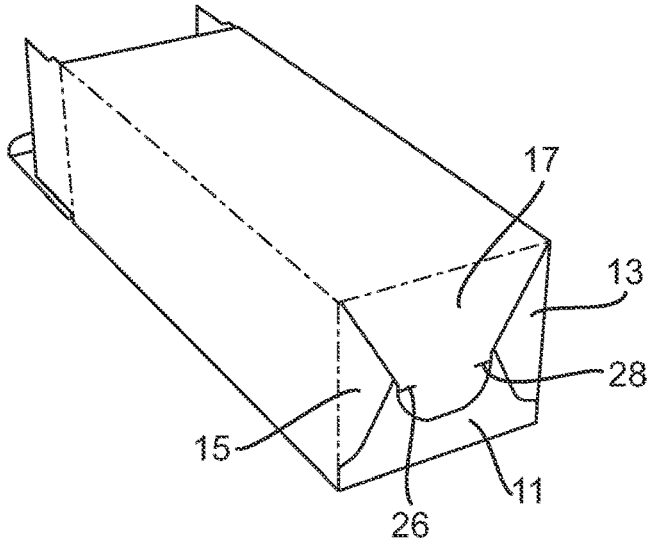

The fourth base flap 17 is then rotated about the foldline 18 connecting it to the fourth sidewall 9 in the direction of the arrow shown in FIG. 4E to the position shown in FIG. 4F. Thus the fourth base flap 17 is folded over the second and third base flaps 13, 15 to a position in which it lies perpendicular to the sidewall 9 to which it is connected.

Figure 4G:
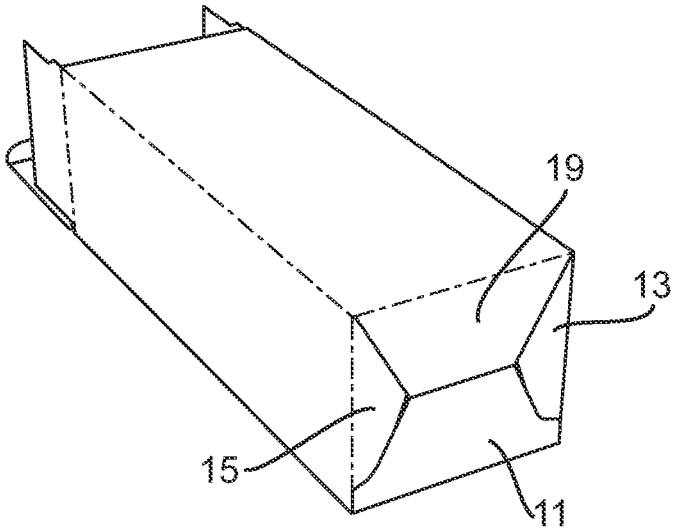

The distal end of the fourth base flap 17 is then inserted into the interior of the container. As the fourth base flap is inserted into the interior of the container, it causes the hooks 50, 50' associated with the distal portions of the second and third base flaps 13, 15 to be tucked behind the edge 41 of the recess 22. In this way, a closed base is obtained as shown in FIG. 4G. The base panel portion 19 of the fourth base flap 17 forms part of the exterior of the base. The locking tab portion 21 extends through a slot defined by the end regions of the distal portions 63, 63' of the second and third base flaps 13, 15 and the proximal edge 41 of the recess 22 of the first base flap 11. In the embodiments illustrated, in which the distal portions of the second and third base flaps define hooks, a surface of the respective base flaps in the region of the hooks defines the slot with the edge 41 defined by the first base flap. In the embodiment illustrated, an outer surface of the base of the hooks defines the slot with the edge 41. However, in other embodiments, e.g. where no hooks are provided, the side edges 69, 69' of the distal portions of the second and third base flaps may define the slot with the edge 41. Where hooks are provided, the surface of the distal portions of the second and third base flaps which define the slot with the first base flap may be a region away from the base, or even proximal to the base of the hooks.

The cutlines are not visible in FIG. 4G, being disposed in the region where the locking tab portion 21 bends around to enter the interior of the container, where they may cooperate with the side edges of the second and third base flaps 13, 15.

In the embodiment illustrated, it will be seen that the slot is present in the closed base, but not prior to the final stage of tucking the locking tab portion of the fourth base flap into the interior of the container.

Modifications may be made to the method described in relation to FIGS. 4A-G, which illustrates only one exemplary method for erecting the container. For example, rather than tucking the hooks associated with the second and third base flaps behind the edge 41 as part of the step of inserting the locking tab portion into the interior of the container, this may be carried out as a separate, preceding step.

The resulting closed base has the appearance of the reverse of an envelope, and may be referred to as an "envelope" base. It will be seen that parts of the proximal portions 61, 61' of the second and third base flaps 13, 15 and the proximal portion 35 of the first base flap 11 also form part of the exterior of the base.

A product may then be loaded into the container so as to be supported by the closed base, and the flaps 300 used to provide a closed lid.

Figure 5:
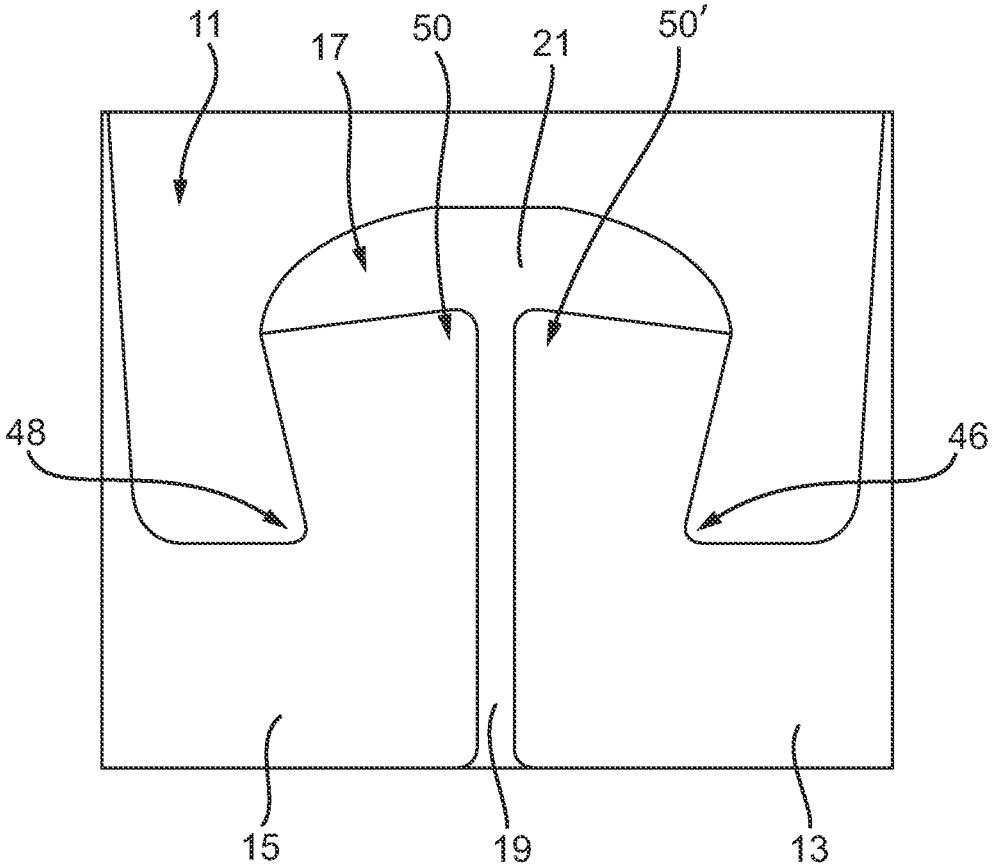
FIG. 5 illustrates the interior of the base of the container of FIG. 4G through the open lid.

The base of the container as shown in FIG. 4G when viewed from the interior is shown in FIG. 5. Here it may be seen how, viewed from the interior, the locking tab portion 21 overlies a part of the proximal portion 35 of the first base flap 11. The hooks 50, 50' of the distal portions 63, 63' of the second and third base flaps 13, 15 may also be seen. A base portion of the locking tab portion 21 is sandwiches between these hooks and the first base flap. The extent of this sandwiching effect depend upon the sharpness of the ends of the hooks, and the extent to which the hooks extend beyond the edge 41. The distal portions 37, 39 of the first base flap 11 overlie the distal portions 63, 63' of the second and third base flaps. The hooks defined by the distal portions 37, 39 help to ensure that the portions remain in position even when an outwardly directed force is exerted on the interior of the base in use, when a product is located therein. The use of hooks on the second, third and first base flaps thus assists in maintain the base in a closed state even when outward forces are exerted on the interior thereof in use, further improving the strength of the base. However, these are only preferred features.

The cutlines 26, 28 have been found to help prevent the locking tab portion 21 of the fourth base flap 17 from coming out of the slot when a force is applied to the interior of the base urging it outwardly (i.e. as would be the case if a product is located in the container), and hence to improve the strength of the base. The main cause of failure of this type of base would be the locking tab coming out of the slot, as this is what maintains the base in its closed configuration. It has been found that the cutlines may catch on the side edges of the second and third base flaps 13, 15 closest to the first base flap 11 in the region of the transition between the proximal and distal portions 61, 63, 61', 63' of the flaps 13, 15. This is the region where the side edge 69, 69' of the distal portion 63, 63' meets the first portion 70, 70' of the side edge of the proximal portion of the flap. The side edges of the second and third base flaps are received in the cutlines preventing the locking tab portion 19 from moving out of the slot.

The cutlines may be located at various points around the transition between the base panel portion 19 and locking tab portion 21 of the fourth base flap 17 to enable them to function in this way. However, it has been found that it is advantageous if the cutlines are located so as to be in the region where the locking tab portion bends around to enter the base i.e. between the inner and outer walls of the base, or just on the interior of the base of the container so as to enable them to most reliably receive the edges of the second and third base flaps and prevent movement of the locking tab portion out of the slot, at least if a force applied to the interior of the base by a product located within the container causes the locking tab portion to tend to move out of the slot. In the embodiment illustrated, the cutlines are located just distal to the point at which their respective side edge starts to change direction as the base panel portion 19 transitions into the locking tab portion 21.

Figure 6:
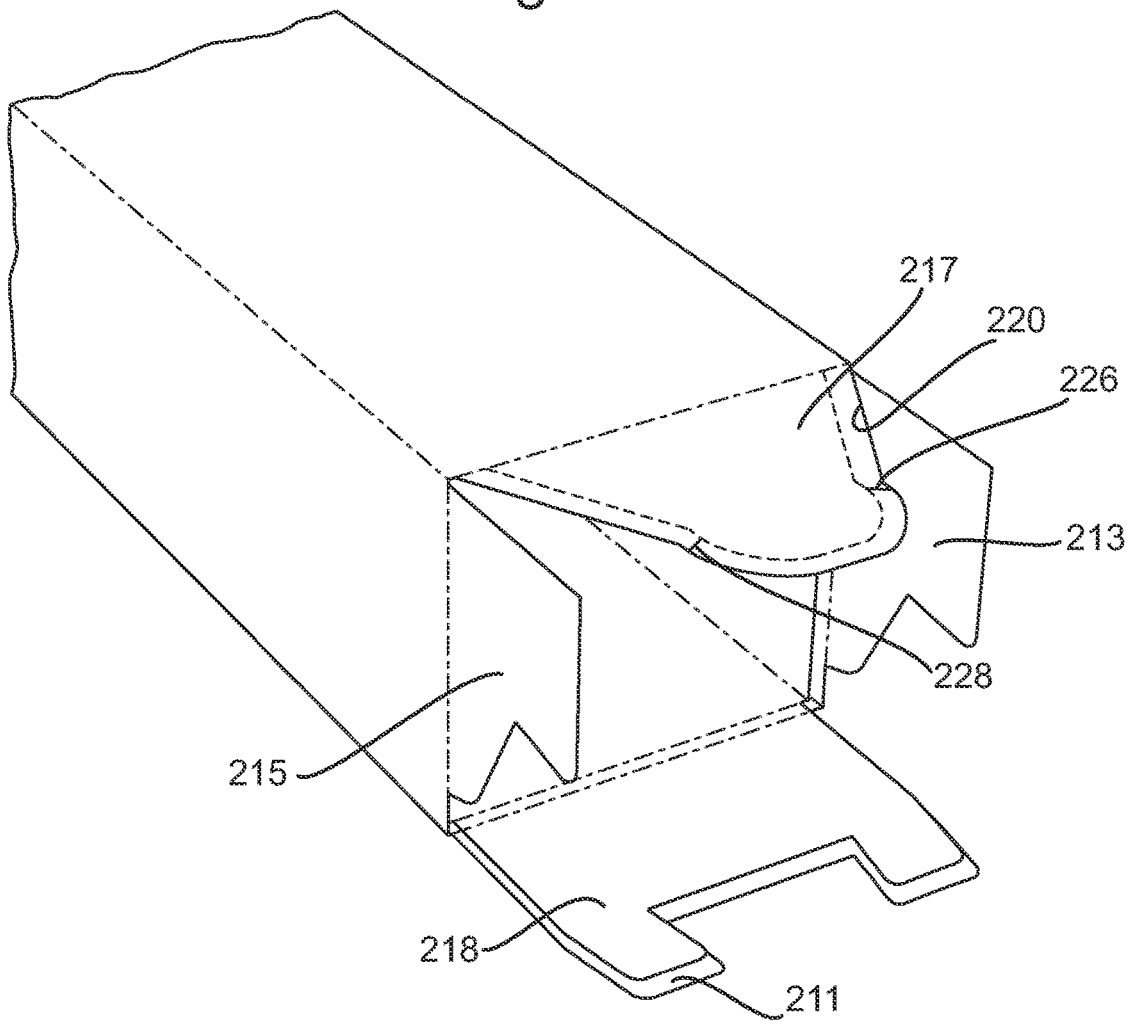
FIG. 6 illustrates an alternative embodiment including reinforcement flaps.

FIG. 6 illustrates a further embodiment of the invention, in which a container 200 has first, second, third and fourth base flaps of similar construction to the embodiment of FIG. 3. The fourth base flap has cutlines 228, 226. However, in this embodiment, a first reinforcement flap 218 is disposed within the first base flap 211, and a second reinforcing base 220 is located within the fourth base flap 217. The reinforcement flaps may be associated with the ends of sidewalls of an inner shell of the container, or may be provided in any other suitable manner. Closure of the base of this further embodiment proceeds in the same manner described in relation to FIGS. 4C-G. In this case, when the first base flap 211 is folded up the first reinforcement flap 220 is folded up within it to underlie the first base flap 211. When the locking tab portion of the fourth base flap 217 is pushed into the interior of the container, it causes the second reinforcement flap 220 to move with it such that a distal end of the second reinforcement flap will underlie the locking tab portion, providing a reinforcement to the locking tab portion. The distal end of the second reinforcement flap will thus extend through the slot, underlying the locking tab portion.

In this embodiment, the first and second reinforcement flaps have the same shape as their corresponding base flaps, but have an outer contour lying within the contour of the base flap. This may provide some tolerance to ensure the reinforcement flaps are not visible from the exterior of the closed base. Thus, the second reinforcement flap defines correspondingly shaped portions for reinforcing the base panel and locking tab portions of the fourth base flap. However, in other embodiments the reinforcement flaps may have a different shape to their base flaps, provided they extend over a sufficient area to reinforce the base flaps. For example, the first reinforcing base flap may extend over only the proximal portion of the first base flap 218. These embodiments may further enhance the strength of the base, providing additional benefits. This is synergistic with the strength benefits provided by the use of the cutlines. The use of reinforcement flaps may increase strength in those areas of the base where particularly critical, but without the need to e.g. laminate layers together to provide a double thickness over the entire container, which may disadvantageously add processing complexity. The second reinforcement flap need not include cutlines, although in some embodiments, it may include cutlines at a corresponding position to the fourth base flap. In these embodiments, the reinforcement flaps are unsecured to their respective base flaps. However, in other embodiments it is envisaged that some attachment may be used, although advantageously an unsecured arrangement is used, to provide reinforcement in key areas of the base, but without the added complication of bonding the flaps together.

It is envisaged that only one of the first and second reinforcement flaps may be used, or additional reinforcement flaps may be associated with the second and third base flaps.

It will be appreciated that the present invention may be used in conjunction with a container having an inner shell regardless of whether reinforcement flaps are provided. The sidewalls associated with the first, second, third and fourth base flaps will then form part of the outer shell. An inner shell may be of any suitable construction, and may be provided as part of the same blank which provides an outer shell. An inner shell may help to support a product within the container and/or reinforce the sidewalls of the outer shell of the container. For example, an inner shell may reinforce the sidewalls of the outer shell of the container to provide additional strength. This may provide a particularly strong container in conjunction with the base structure described herein. An inner shell may be of any suitable construction e.g. in terms of number of sidewalls, shape of sidewalls, extent of sidewalls relative to the sidewalls of the outer shell, position of sidewalls relative to sidewalls of outer shell etc.

FIG. 7 illustrates yet further examples of shapes which may be used for the first, second, third and fourth base flaps in any of the embodiments of the invention, whether or not reinforcement flaps are used. This figure illustrates some exemplary flap shapes, which happen to be shown in a different order to the blank of FIGS. 1 and 2. The flap shapes are respectively for the first flap (300), second and third flaps (308, 304) and fourth base flap (306). These illustrate an embodiment in which the distal portions of the second and third base flaps define sharper hooks which may tuck behind the edge defined by the recess in the first base flap. In these embodiments, the slot may be defined by a surface of the distal portions of the second and third base flaps in the region of the base of the hooks.

A container in accordance with the embodiment of FIGS. 1 and 2 (invention) was tested to determine the weight of a bottle which could be held before the base failed as a result of the locking tab portion of the fourth base flap coming out of the slot. The container was compared to a container of identical construction, but without the cutlines (comparative). Tables 1 and 2 show the result of testing the comparative and inventive arrangements respectively. In each case, an average of 10 replicates was taken.

Table 3 summarizes the results obtained. It may be seen that considerable improvements in the minimum, maximum and average load at break was provided by the invention in comparison to the comparative example.

Base factor is a safety factor indicative of a force required to push a bottle through the base. For example, a 6 kgf required to push a 1.5 kg bottle through the base will provide a factor of safety of 4.

Comparative

TABLE 1

| Load at Maximum Load (kgf) | Load at Break (kgf) | Filled Bottle Weight (kg) | Base Factor |
|---|---|---|---|
| 16.01 | 12.80 | 1.15 | 14.98 |
| 15.70 | 12.56 | 1.15 | 14.71 |
| 15.52 | 12.42 | 1.15 | 14.56 |
| 15.78 | 12.62 | 1.15 | 14.78 |

TABLE 1-continued

| Load at Maximum Load (kgf) | Load at Break (kgf) | Filled Bottle Weight (kg) | Base Factor |
|---|---|---|---|
| 15.01 | 12.01 | 1.15 | 14.11 |
| 14.98 | 11.98 | 1.15 | 14.08 |
| 15.21 | 12.17 | 1.15 | 14.29 |
| 16.03 | 12.82 | 1.15 | 15.00 |
| 14.97 | 11.98 | 1.15 | 14.07 |
| 15.89 | 12.71 | 1.15 | 14.88 |
| 15.51 | 12.41 | 1.15 | 14.55 |

Invention

TABLE 2

| Load at Maximum Load (kgf) | Load at Break (kgf) | Filled Bottle Weight (kg) | Base Factor |
|---|---|---|---|
| 30.13 | 24.11 | 1.15 | 27.32 |
| 24.02 | 19.22 | 1.15 | 21.98 |
| 26.47 | 21.18 | 1.15 | 24.12 |
| 30.24 | 24.20 | 1.15 | 27.41 |
| 23.28 | 18.63 | 1.15 | 21.33 |
| 26.83 | 21.46 | 1.15 | 24.43 |

TABLE 3

| Summary | Comparative Load at break (kgf) | Invention Load at break (kgf) | Improvement |
|---|---|---|---|
| Min | 14.07 | 21.33 | 52% |
| Average | 14.55 | 24.43 | 68% |
| Max | 15.00 | 27.41 | 83% |

While attachments have been described as adhesive attachments herein, it will be appreciated that any suitable bonding technology e.g. heat sealing may be used, or combinations of such technologies.

While the slot defining edge of the first base flap has been illustrated as a proximal edge of a recess in the distal edge thereof, the slot defining edge may instead be provided by an edge e.g. proximal edge of an opening in the flap.

All of the assembly steps described by reference to FIGS. 4A-G, including all gluing and folding steps, may be performed in a fully automated manner by a machine.

It will be understood that the above description is of a number of exemplary embodiments only and that modifications may be made to the embodiments without departing from the scope of the invention.

The invention claimed is:

1. A container comprising;

a plurality of sidewalls connected to one another along foldlines; and a base, wherein the base comprises;

a first base flap connected along a foldline to a first one of the sidewalls;

second and third opposed base flaps connected along respective foldlines to respective ones of the sidewalls adjacent the first sidewall on either side thereof, wherein the second and third base flaps are folded over the first base flap;

and a fourth base flap connected along a foldline to a sidewall opposite the first sidewall, wherein the fourth base flap is folded over the second and third base flaps;

wherein the fourth base flap comprises a base panel portion which forms part of the exterior of the base and a locking tab portion connected to a distal end of the base panel portion, wherein the locking tab portion of the fourth base flap is inserted into the interior of the container through a slot defined by the first, second and third base flaps to retain the base in a closed configuration;

and wherein a cutline is provided extending inwardly from the side edge of the fourth base flap on each side of the fourth base flap at a transition between the base panel portion and the locking tab portion of the fourth base flap.

2. The container of claim 1 wherein each cutline receives an edge of a respective one of the second and third base flaps to inhibit movement of the locking tab portion out of the slot.

3. The container of claim 1 wherein each cutline extends less than 30% of a distance toward an opposite side edge of the fourth base flap.

4. The container of claim 1 wherein each cutline extends at least 5% of a distance toward an opposite side edge of the fourth base flap.

5. The container of claim 1 wherein each cutline extends at least 5% and less than 30% of a distance toward an opposite side edge of the fourth base flap.

6. The container of claim 1 wherein the cutlines converge with one another.

7. The container of claim 6 wherein the cutlines are inclined toward the foldline connecting the fourth base flap to the sidewall of the container to which the fourth base flap is connected.

8. The container of claim 1 wherein the second and third base flaps each comprise proximal and distal portions, and the slot is defined by an edge region of the distal portion of each one of the second and third base flaps and an edge defined by the first base flap.

9. The container of claim 8 wherein the first base flap comprises a recess formed in a distal end thereof, wherein a portion of a distal edge of the first base flap defining a proximal end of the recess provides the edge defined by the first base flap which cooperates with edge regions of the distal portions of the second and third base flaps to define the slot through which the locking tab of the fourth base flap is inserted.

10. The container of claim 9 wherein the first base flap comprises distal end portions on either side of the recess, wherein an inner edge region of each distal end portion of the first base flap defines a hook.

11. The container of claim 1 wherein each cutline extends inwardly from a side edge of the fourth base flap in proximity to a point at which a direction of the side edge of the fourth base flap changes direction as the base panel portion of the fourth base flap transitions into the locking tab portion.

12. The container of claim 11 wherein each cutline extends inwardly from the side edge of the fourth base flap starting from a point located distal to a point at which a direction of the side edge of the fourth base flap changes direction as the base panel portion of the fourth base flap transitions into the locking tab portion.

13. The container of claim 1 wherein the base panel portion and the locking tab portion of the fourth base flap are integrally and continuously formed without a preformed fold line therebetween.

14. The container of claim 1 wherein the second and third base flaps each comprise proximal and distal portions, and the slot is defined by an edge of the distal portion of each one of the second and third base flaps and an edge defined by the first base flap and/or by a surface of the distal portion of each one of the second and third base flaps and an edge defined by the first base flap.

15. The container of claim 1 wherein the second and third base flaps each comprise proximal and distal portions, and the distal portions of each of the second and third base flaps define hooks, wherein the hooks are tucked behind a slot-defining edge of the first base flap.

16. The container of claim 1 wherein the second and third base flaps each comprise a proximal and a distal portion, wherein a side edge of the flap changes direction at a transition between the proximal and distal portions thereof, and wherein each cutline receives an edge of a respective one of the second and third base flaps at the transition between the proximal and distal portions of the second or third base flap to inhibit movement of the locking tab portion out of the slot.

17. The container of claim 1 wherein a respective reinforcement flap is provided underlying at least one of the first and fourth base flaps, wherein the respective reinforcement flap is connected to a respective sidewall of an inner shell of the container along a respective foldline, and the reinforcement flap is in face to face contact with, and unsecured to, the inner surface of its respective base flap.

18. The container of claim 1 wherein the container comprises inner and outer shells, wherein the outer shell comprises the sidewalls to which the first, second, third and fourth base flaps are connected.

19. A blank erectable to provide a container in accordance with claim 1.

20. The container of claim 1 wherein at least one side edge of the fourth base flap is a free edge, and wherein a width of the fourth base flap is not its narrowest at the transition between the base panel portion and the locking tab portion of the fourth base flap.

* * * * *